United States Patent [19]

Aanstad

[11] 4,005,581

[45] Feb. 1, 1977

[54] METHOD AND APPARATUS FOR CONTROLLING A STEAM TURBINE

[75] Inventor: Ola J. Aanstad, Greensburg, Pa.

[73] Assignee: Westinghouse Electric Corporation, Pittsburgh, Pa.

[22] Filed: Jan. 24, 1975

[21] Appl. No.: 543,852

[52] U.S. Cl. ..... 60/660; 415/17

[51] Int. Cl.[2] ..... F01K 13/02

[58] Field of Search ..... 60/660–667; 415/17; 290/2

[56] References Cited

UNITED STATES PATENTS 3,545,207 12/1970 Barber et al. ..... 60/664 X 3,572,958 3/1971 Kure-Jensen ..... 415/17

3,774,396 11/1973 Borsi et al. ..... 290/2 X

*Primary Examiner*—Allen M. Ostrager

*Attorney, Agent, or Firm*—E. F. Possessky

[57] ABSTRACT

An electric power plant steam turbine system with digital computer control in which control signals are generated as a function of the actual steam conditions present in each turbine section and in a manner which maintains the sum of the instantaneous power developed in each turbine section equal to the total demand placed upon the turbine system.

59 Claims, 8 Drawing Figures

METHOD AND APPARATUS FOR CONTROLLING A STEAM TURBINE

CROSS REFERENCE TO RELATED APPLICATIONS

1. Application Ser. No. 408,962, entitled "System and Method for Starting Synchronizing and Operating a Steam Turbine with Digital Computer Control", filed by Theodore C. Giras and Robert Uram on Oct. 23, 1973, as a continuation of application Ser. No. 247,877, filed on Apr. 26, 1972, now abandoned, both of which are assigned to the same assignee as this invention, is hereby incorporated by reference into this application for the purpose of identifying the state of the art pertinent to certain aspects of the present invention.

2. Application Ser. No. 250,337, now U.S. Pat. No. 3,873,817 entitled "On-Line Monitoring of Steam Turbine Performance", filed by Chu Yu Liang on May 4, 1972 and assigned to the same assignee as this invention, is also hereby incorporated by reference into this application for the purpose of identifying the state of the art pertinent to certain aspects of the present invention.

BACKGROUND OF THE INVENTION

1. Field of the Invention

This invention relates to steam turbines and more particularly to apparatus and methods for controlling such turbines as a function of the actual steam conditions in each turbine section.

2. State of the Prior Art

Steam turbines are controlled for the most part by modulating the flow of steam to the turbine through one or generally a group of control valves. Steam flow is controlled to provide appropriate regulation of an end-controlled variable selected for the particular turbine system application. In large electric power generating systems the end-controlled variable is the frequency of the electric power generated which is a function of turbine speed and/or the electrical load carried by the turbine-generator combination.

Under speed control operation a signal developed as a function of the actual speed of the turbine is compared with a reference speed signal and the resultant error signal is utilized in a servo loop to position the control valves to drive the turbine to the desired speed. Speed control is used in ship propulsion systems, boiler feed pump drives, etc., to regulate turbine speed as the end-controlled variable. In electric power generating turbine systems, speed control is normally utilized during start-up and in most instances during shutdown and is also employed to regulate the frequency participation of the individual turbine-generator units in an electric power generating network. The frequency participation of individual turbine-generator units is determined by the proportion of any change in system electrical load assumed by each unit. Due to the presence of substantial inductive loading in commercial electric power networks, any increase in load carried by the system tends to lower the system frequency. Correspondingly, any reduction in load tends to raise system frequency. As the increase in load tends to drive system frequency downward, the speed error produced in the speed control loop will drive the control valves further open to admit more steam, and thus more thermal energy, to the turbine to provide the additional power required to sustain the load at the rated frequency. The gain of the speed control loop determines the percentage of frequency participation of the individual turbine-generator units.

Under load control operation, a reference signal representative of the desired megawatt load to be carried by the turbine-generator unit as determined automatically by an automatic dispatch system or manually by an operator is applied to a turbine control loop. While such a loop may, and in many cases does, include a feedback signal representative of the actual electrical power provided by the generator, the response time of such a loop is very slow, especially in a large electric power generating unit which conventionally includes a high-pressure turbine section, followed by an intermediate pressure turbine and then a low-pressure turbine with a reheater interposed between the high-pressure turbine and the intermediate pressure turbine. It has been determined, however, that when steam is supplied to the turbine system at constant throttle pressure and temperature, the steady state load carried by the turbine-generator unit may be characterized as a direct linear function of the turbine first-stage steam pressure. Thus the final control valve position resulting from a change in desired megawatt load to be carried by the turbine-generator unit can be anticipated by controlling the position of the turbine control valves as a function of an error signal generated as the difference between the megawatt demand signal and a feedback signal proportional to turbine first-stage steam pressure.

The above form of load control functions satisfactorily as long as turbine inlet and exhaust conditions remain constant. However, turbine exhaust conditions are affected by such factors as air leakage, reduced efficiency of the condenser due to fouling of tubes, etc., and variations in condenser circulating water flow and/or temperature. While in the past river or lake water, which remains fairly constant in temperature over prolonged periods, was predominantly used as the condenser coolant (circulating water) and discharged after use, environmental considerations have prompted the recirculation of condenser coolant and the use of cooling towers. Since cooling towers are subject to the larger and shorter term fluctuations of atmospheric conditions, the condenser back pressure on the low-pressure turbines in such an arrangement varies over a wider range and in a shorter period of time than the previous systems. Wet or dry operation of the cooling towers also has significant influence on the efficiency of the cooling towers. The resultant effect is that condenser pressure in a large electric power generating turbine may vary over a relatively wide range. A change in condenser pressure will influence the turbine power even if the turbine first-stage steam pressure remains constant during the transient.

The turbine first-stage steam pressure characterization of turbine power is also premised upon a supply of steam at a predetermined thermal state point, i.e., constant inlet steam conditions. While in many turbine systems the steam generators are capable of supplying steam at substantially constant throttle pressure and temperature over the full operating range of the turbine, in some installations full throttle pressure can not be maintained at full load. There has also been a renewed interest of late in sliding pressure control of steam turbine cycles wherein the turbine control valves remain full open and the pressure of the steam supplied by the steam generator is regulated to control the power developed by the turbine. The advantages and disadvantages of this type of control and of a hybrid system combining constant throttle pressure control over a portion of the turbine operating load range and sliding pressure-control over the remaining portion is discussed in a paper by George J. Silvestri, Jr., Ola J. Aanstad and James T. Ballantyne, entitled "A Review of Sliding Throttle Pressure For Fossil Fueled Steam-Turbine Generators", which was presented at the American Power Conference in Chicago, Ill., Apr. 18–20, 1972.

For units operating with superheated steam and variable inlet pressure over the load range, the turbine control valves are normally used to participate in controlling system steam pressure. In this case, the first-stage pressure alone can not be used as a feedback signal in the control valve positioning loop due to severe interaction with the overall pressure control system. It is necessary in such arrangements to therefore rely on other means for load control.

In the control system described in the above-referenced paper, a throttle pressure characterization of the megawatt demand is employed to control the positioning of the control valves. A signal proportional to the ratio of the first-stage pressure to the throttle pressure is also applied to the control loop as a turbine steam flow feedback signal. However, this control scheme, as well as the other prior art systems, fails to take into account that the state point of the turbine inlet steam is dependent upon temperature as well as pressure and that a change of inlet pressure is accompanied by a change in temperature so that a pressure characterization alone is not an accurate representation of turbine power.

Under speed control operation, variations in turbine inlet and/or exhaust conditions are compensated for by the speed feedback signal. Similarly, in load control operation, a signal representative of the actual electrical power generated by the generator can be fed back into the control loop to compensate for variations in turbine inlet and/or exhaust conditions. In one scheme, a megawatt error signal is integrated and multiplied by the load demand signal to provide multiplication calibration for load error. A serious shortcoming of both the prior art speed control and load control schemes is that they rely upon feedback signals developed at the output of the system and thus are subject to sizable delays in response resulting from the system time constants. In a large multi-element electric power generating turbine unit with a reheater, the time constant may be in the neighborhood of 10 to 15 seconds. These large delays in response time can be compensated for to some extent by the use of feedforward control techniques and by the application of various combinations of control action to the valve position signals. However, these schemes still rely on the first-stage pressure characterization of turbine power which does not account for the variations in turbine inlet and exhaust conditions.

It is also known that turbine inlet and exhaust steam temperatures and pressures can be read and even monitored on a continuing basis, but heretofore these readings have been taken in order to calculate heat rate, turbine efficiency and other performance indicators and have not been utilized to control the operation of the turbine. In this regard, the Liang application cited above teaches methods and apparatus for calculating performance indicators even for turbine systems such as PWR nuclear fueled electric power generating systems in which portions of the turbine systems are operating on wet steam wherein the state point of the steam necessary for making many of the calculations can not be determined by conventional techniques.

In addition to need for control systems which overcome the specific problems discussed above, there is a continual requirement for new generation control systems which provide improved turbine performance in general, such as reduced response time to changes in load or frequency and minimum overshoot during transient.

SUMMARY OF THE INVENTION

In accordance with the broad principles of this invention, a steam turbine is controlled as a function of the actual steam conditions present in the turbine. In this regard, an operating representation generated as a function of turbine first-stage and exhaust steam state points is utilized to control the flow of steam to the turbine. More specifically, a representation of the steam enthalpy drop resulting from the expansion of the steam as it imparts torque to the turbine shaft is generated such as from the turbine first-stage and exhaust steam temperatures and pressures. A steam flow demand or control signal is then generated as a function of the enthalpy drop and a reference signal representative of the demand placed upon the turbine. This reference signal may be generated as a function of a predetermined turbine speed or a predetermined load to be carried by the turbine, or a combination of the two. A turbine first-stage steam pressure demand or control signal which is utilized in a servo loop to position the control valves and thereby regulate the flow of steam to the turbine is generated as a function of the flow control signal and turbine first-stage steam temperature and exhaust steam pressure.

When controlled in this manner, the turbine responds rapidly and accurately with minimum overshoot to changes in load and speed demand. This form of control is particularly suitable for systems in which the state point of the inlet steam does not remain constant over the turbine operating range or for systems with large changes in operating condenser pressure. While the prior art pressure characterization could only accommodate for variations in inlet steam pressure (by pressure ratio compensation), the present invention also accommodates for inlet steam temperature and exhaust pressure variations. Even with constant throttle pressure and steady exhaust conditions, the present invention provides improved turbine control by reducing response time to load and frequency changes and by minimizing overshoot.

As applied to a multi-element turbine, the invention contemplates that a representation of the instantaneous power delivered by the low-pressure turbine element, and where applicable by the intermediate pressure turbine element, be generated and subtracted from the total demand placed upon the turbine to determine the reference demand for the high-pressure turbine element which is then controlled in the manner discussed above. With this arrangement, changes in demand or variations in turbine inlet or exhaust conditions are accommodated for rapidly and accurately with minimum overshoot, initially by the high-pressure turbine element alone until the slower reacting intermediate and low-pressure turbine elements catch up. The instantaneous low and intermediate pressure turbine element power representations are generated from the enthalpy drops calculated as a function of the respective first-stage and exhaust steam state points, and element steam flows calculated from the respective first-stage and exhaust steam pressures and first-stage steam temperature.

The preferred embodiment of the invention utilizes a general purpose digital computer for determining the control action applied to the turbine control valves.

DESCRIPTION OF THE PREFERRED EMBODIMENTS OF THE INVENTION

Figure 1:
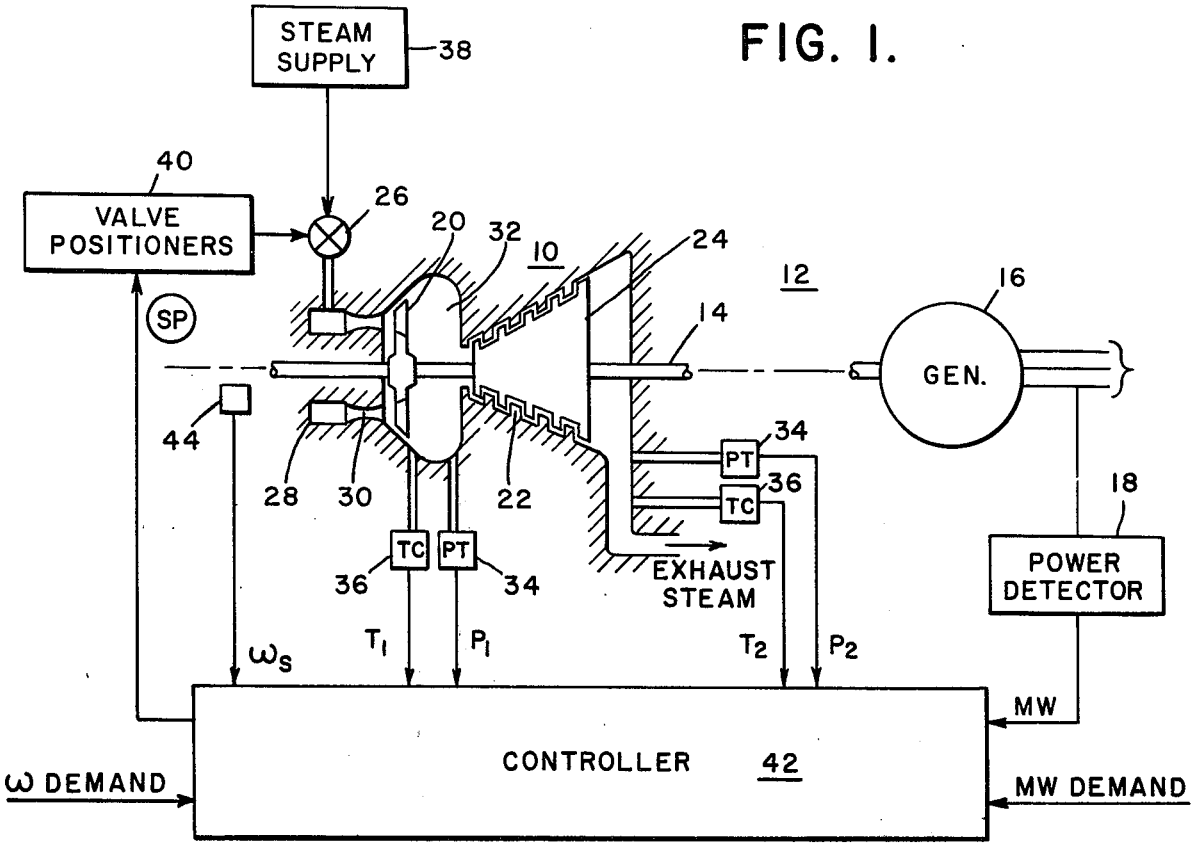
FIG. 1 is a schematic diagram of an electric power plant single element steam turbine system incorporating and operated in accordance with the principles of the invention.

FIG. 1 illustrates a single-element steam turbine 10 constructed in a well-known manner and operated and controlled in accordance with the principles of the invention as part of an electric power plant 12. Other types of steam turbines, including, but not limited to, the multi-element single reheat turbine described below can also be controlled in accordance with the principles of the invention.

The turbine 10 is provided with a single shaft 14 which drives a conventional alternating current generator 16 to produce three-phase (or other phase) electric power sensed by a conventional power detector 18. Typically, the generator 16 is connected through one or more breakers (not shown) per phase to an electric power network and when so connected causes the turbogenerator arrangement to operate at synchronous speed under steady state conditions. Under transient electric load change conditions system frequency may be affected and conforming turbogenerator speed changes would result. At synchronism, power contribution of the generator 16 to the network is determined by turbine steam flow.

The turbine 10 of FIG. 1 is a conventional single element axial flow type turbine comprising a single turbine unit. This single element includes a control stage 20 connected to the shaft 14 and a plurality of reaction stages provided by stationary vanes 22 and an interacting bladed rotor 24 also connected to the shaft 14.

For purposes of illustration, the turbine 10 is further provided with a plurality of throttle or stop valves and a plurality of control or governor valves designated collectively as inlet valves 26. A more detailed description of a particular throttle and control valve arrangement is presented in the aforementioned Giras and Uram copending application which has been incorporated by reference into this application.

Steam admitted to the turbine by the inlet valves 26, enters the nozzle chamber 28 from which it is directed by nozzles 30 onto the blading of the control stage 20 located upstream of the impulse chamber 32. Next, the steam passes through the reaction stages where it imparts torque to the shaft 14 as it expands. The vitiated steam is then exhausted.

Pressure transducers 34 and thermocouples 36 both of well-known types provide indications of steam pressure and temperature respectively at the inlet and exhaust of the turbine reaction stages. Steam pressure at the inlet to the reaction stages is generally referred to as first-stage pressure, although in turbines such as that illustrated in FIG. 1 having an impulse chamber, it is alternatively referred to as impulse chamber pressure. Conventionally, steam pressure upstream of the inlet valves is referred to as inlet pressure. Although first-stage pressure can be derived from the inlet pressure as a function of valve position, it is more expedient to monitor the first-stage pressure directly. For turbines not equipped with inlet valves, such as the low and intermediate pressure turbines in the multi-element turbine system described below, the terms "inlet" and "first-stage" as applied to steam pressure and temperature are interchangeable. However, to avoid confusion, the term first-stage will be used henceforth to indicate the designated condition of the steam prior to its entry into the reaction stages of the turbine however derived.

Steam for driving the turbine is developed by a steam supply system 38 which may comprise any one of the many types of boiler systems such as the conventional drum type or once through boiler systems operated by fossil or nuclear fuel. In accordance with the invention, the steam supply system may be of the constant throttle pressure type, the sliding pressure type or a hybrid system such as that described in the aforementioned paper by Silvestri, Aanstad and Ballantyne.

The inlet valves 26 are operated by valve positioners 40 which include conventional hydraulically operated valve actuators (not shown) and associated stabilizing position controls (not shown) for each valve. The position controls each include a conventional position error feedback operated analog controller which drives a suitable known actuator servo in a well-known manner. The valve position feedback signal for developing the position error signal is provided by respective conventional valve position detectors. The combined position control, hydraulic actuator, valve position detector and other miscellaneous devices (not shown) all represented as the valve positioners 40, form a local hydraulic-electrical analog valve position control loop for each throttle and control inlet steam valve.

In accordance with the invention, the set points for the various inlet valves are supplied to the valve positioners 40 by a controller 42. Inputs to the controller 42 include the speed, $\omega_s$, of the turbogenerator combination generated by a conventional speed detector 44, the megawatt electric power, MW, produced by the generator 16 and detected by power detector 18 and reference signals, $\omega$ DEMAND, and MW DEMAND, for turbine speed and electric power output respectively. The $\omega$ DEMAND signal is generated manually by an operator or automatically under automatic start-up control while the MW DEMAND signal may also be generated manually by the operator, by a suitable known automatic dispatch system or by an overall plant control system. Additional inputs to the controller 42 include first-stage and exhaust steam pressures $P_1$ and $P_2$ respectively generated by transducers 34, as well as first-stage and exhaust steam temperatures $T_1$ and $T_2$ respectively generated by the thermocouples 36.

Figure 2:
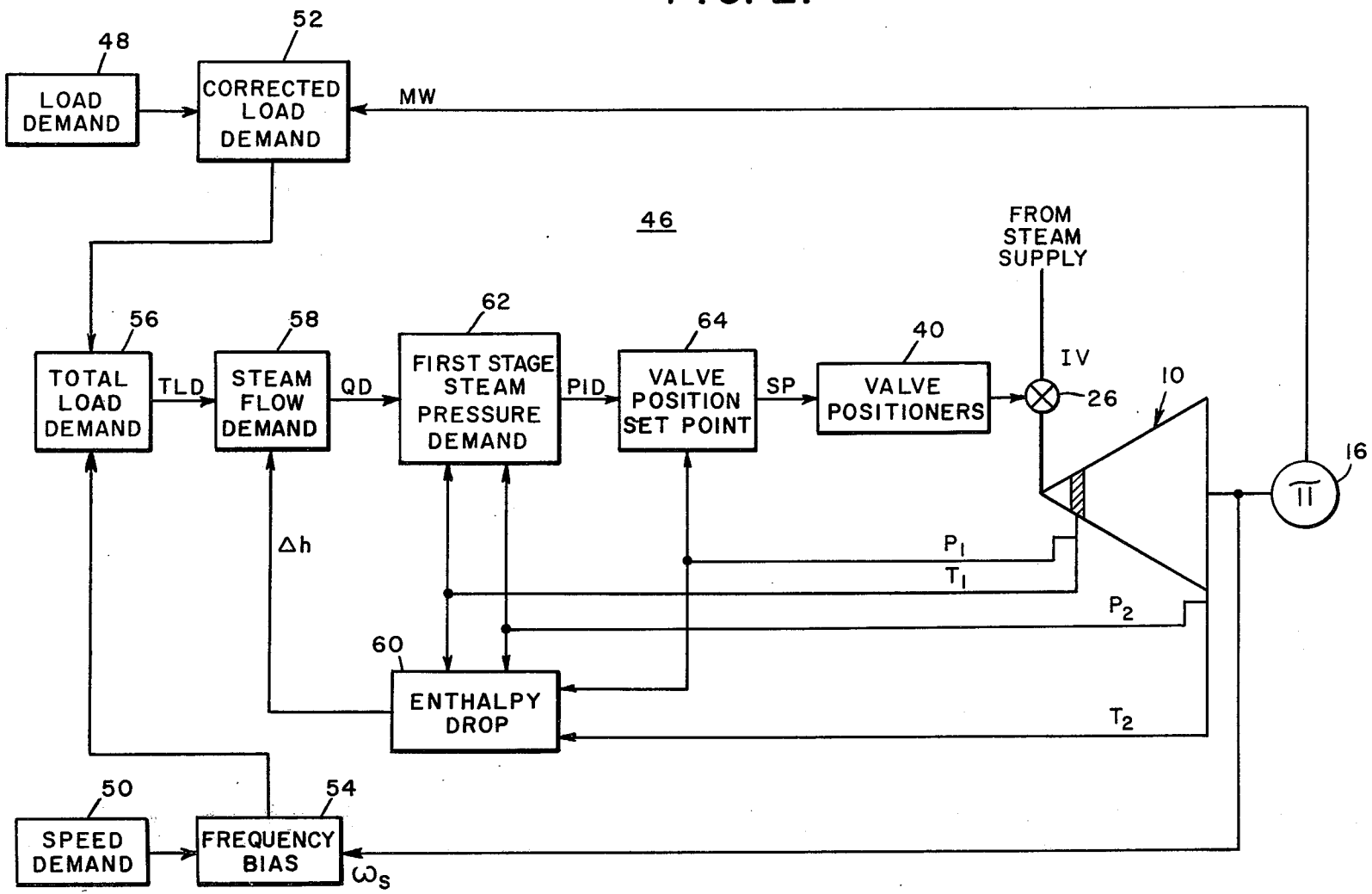
FIG. 2 is a schematic diagram of a control loop for controlling the single element steam turbine illustrated in FIG. 1 in accordance with the principles of the invention.

FIG. 2 illustrates the preferred arrangement 46 of control loops employed to control the single element turbine shown in FIG. 1. The control loop arrangement 46 is schematically represented by functional blocks, and varying structures can be employed to produce the block functions. In addition, various block functions can be omitted, modified or added in the control loop arrangement 46 consistently with application of the present invention. It is further noted that the arrangement 46 functions within overriding restrictions imposed by elements of an overall turbine and plant protection system (not illustrated in FIG. 2).

The control loop 46 includes a load demand block 48 which generates a signal representative of the load to be carried by the turbine. This load signal is generated in response to a remote automatic load dispatch input, a load input generated by the turbine operator or other predetermined controlling inputs. Similarly, a speed demand signal is generated in block 50 in response to a synchronization speed requirement, a turbine operator input or other speed control inputs such as start-up control inputs.

Although the load demand signal may be utilized directly in a manner to be described below in order to control the flow of steam to the turbine, it may be combined with a representation of the actual electrical load carried by the turbine, MW, in block 52 to produce a corrected load demand signal. Preferably, feed-forward load control is provided by generating a load error from the load demand and the MW feedback signal, applying proportional plus integral control to the load error to produce a megawatt trim signal and multiplying the load demand by the trim signal to produce the corrected load demand signal. A frequency bias is generated in block 54 by applying a predetermined gain to the speed error determined from the speed demand generated in block 50 and the speed feedback signal $\omega_s$. As is well-known, the magnitude of the gain in this speed loop determines the frequency participation of the turbogenerator combination in the power network. The corrected load demand and the frequency bias are combined in block 56 to generate a total load demand, TLD.

The total load demand, TLD, is processed in combination with representations of the actual steam conditions existing in the turbine to generate inlet valve set point signals, SP. The set point signals are generated in the preferred embodiment of the invention by utilizing the total load demand, TLD, and a representation, $\Delta h$, of the drop in enthalpy resulting from the expansion of the steam in the reaction stages of the turbine 10 to generate a steam flow demand or control signal $Q_D$ in block 58. The enthalpy drop $\Delta h$ is determined in block 60 as a function of first-stage and exhaust steam state points. As is well-known, the enthalpy or state point of dry steam can be determined as a function of steam temperature and pressure. Thus the enthalpy drop of the steam coursing through the turbine 10 can be calculated by determining the enthalpy of the exhaust steam as a function of $P_2$ and $T_2$ and subtracting it from the enthalpy of the first-stage steam determined as a function of $P_1$ and $T_1$.

The steam flow demand or control signal $Q_D$ is employed in block 62 together with first-stage steam temperature $T_1$ and exhaust steam pressure $P_2$ to generate a first-stage steam pressure demand or control signal $P_1D$. Feedback control of first-stage steam pressure is then provided by determining the first-stage pressure error from the first-stage pressure demand $P_1D$ and the actual first-stage pressure $P_1$ and applying proportional plus integral control to the error to generate the valve position set point signals, SP, as indicated by block 64. The set point signals in turn operate the valve positioners 40 which position the inlet valves 26 to regulate the flow of steam to the turbine in a manner which causes the turbogenerator combination to operate at the level called for by the total load demand, TLD. Since steam flow to the turbine is regulated as a function of the instantaneous steam conditions in the turbine, it can be appreciated that a turbine operated in accordance with the principles of the invention responds rapidly and accurately to variations in inlet and/or exhaust conditions, as well as to changes in demand placed upon the turbine. Thus the invention is particularly useful with variable throttle pressure steam generators wherein the steam throttle pressure varies over the operating range of the turbine.

Figure 3:
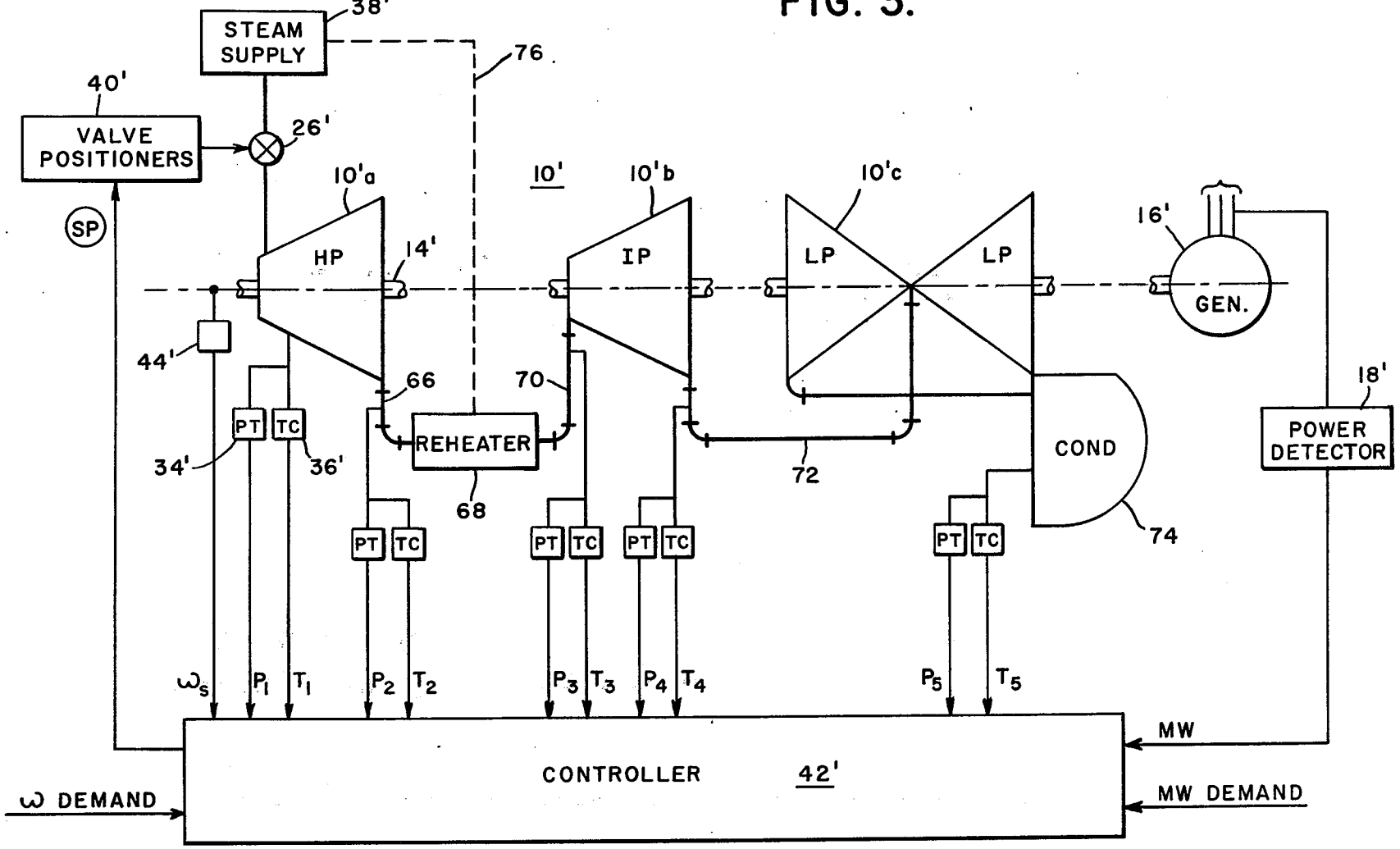
FIG. 3 is a schematic diagram of a large electric power plant multi-element steam turbine system incorporating and operated in accordance with the principles of the invention.

FIG. 3 illustrates the application of the invention to a large multi-element electric power generating turbine system wherein like components to those in the single element turbine system illustrated in FIG. 1 are identified by like reference characters primed. Accordingly, the steam turbine is identified in FIG. 3 by the reference character 10'. This turbine, however, includes a high pressure turbine 10'a similar in construction to the turbine 10 in FIG. 1, an intermediate pressure turbine 10'b and a double low pressure turbine 10'c. All of the turbines, which are of the axial flow type provided with multiple stages of reaction blading, are connected in tandem to a common shaft 14'. The shaft 14' drives a large alternating current generator 16' which generates three phase (or other phase) alternating current as measured by power detector 18'.

Steam which is admitted to the inlet of the high pressure turbine 10'a through inlet valves 26', is directed by a header 66 from the reaction blading of the high pressure turbine to a reheater system 68 where the steam enthalpy is raised. The reheated steam is then directed by header 70 through the intermediate pressure turbine 10'b and then by the cross-over piping 72 to the low pressure turbines 10'c. From the latter, the vitiated steam is exhausted to a condenser 74.

As discussed in connection with the turbine system of FIG. 1, pressure transducers 34' and thermocouples 36′ monitor the first-stage steam conditions in the impulse chamber of the high pressure turbine 10′*a*, as well as the high pressure turbine exhaust steam conditions. Similar pressure transducers and thermocouples detect the first-stage and exhaust steam conditions of the intermediate pressure turbine and the low pressure turbines. Due to the neglible drop in enthalpy of the steam as it passes from the intermediate pressure turbine to the low pressure turbines, a single set of detectors in the crossover piping 72 monitors the common state point of the intermediate turbine exhaust steam and the low pressure turbines first-stage steam. Low pressure turbine exhaust steam conditions are monitored by pressure transducers and thermocouples associated with the condenser.

Steam is supplied to the turbine 10′ by the steam supply 38′ which, as in the case of steam supply 38, may be of the constant throttle pressure type, sliding throttle pressure type or a hybrid type. The reheater 68 is connected to the steam supply 38′ in heat transfer relationship as indicated by 76. In addition, water flow from the condenser 74 is directed (not shown) back to the steam supply 38′.

As in the system of FIG. 1, the valves 26′ which regulate the flow of steam from the steam generator 38′ to the turbine 10′ are controlled by valve positioners 40′ which may take the form of the electro-hydraulic valve positioning controls described above. The set point signals, SP, for the valve positioners are generated by the controller 42′ which has as its inputs the load demand, the actual MW load, the speed demand, the actual speed $\omega_s$, and the high, intermediate and low pressure turbine first-stage and exhaust pressures and temperatures $P_1$ and $T_1$ through $P_5$ and $T_5$, respectively.

Figure 4:
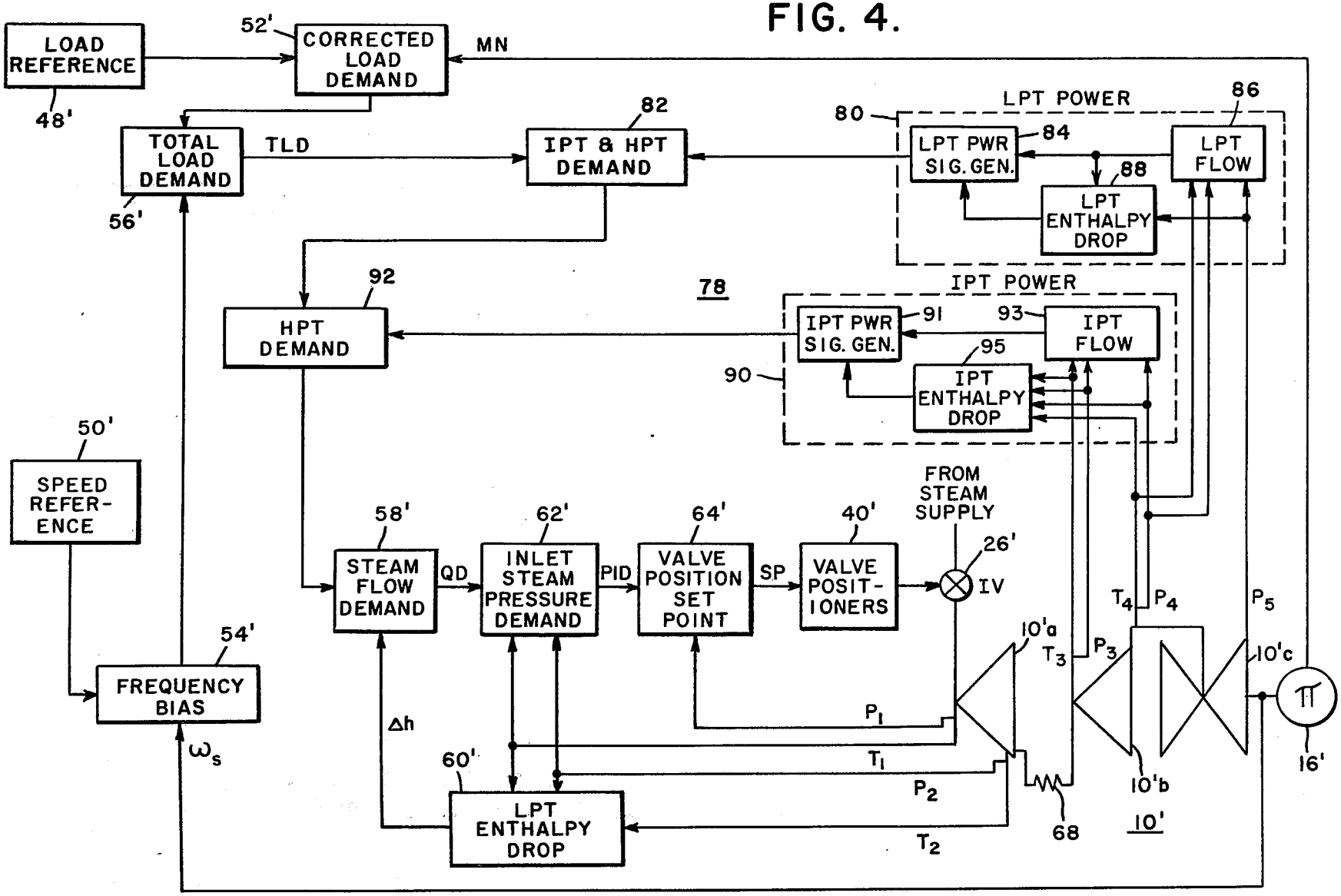
FIG. 4 is a schematic diagram of a control loop for controlling the multi-element steam turbine system illustrated in FIG. 3 in accordance with the principles of the invention.

FIG. 4 illustrates the preferred arrangement of control loops 78 for controlling the operation of the multi-element turbine system shown in FIG. 3 in accordance with the teachings of the invention. As in the control loops of FIG. 2, a load demand generated at block 48′ is preferably combined with the actual load carried by the turbine represented by MW in block 52′ to generate a corrected load demand in a feedforward control loop. Similarly, a frequency bias is provided by block 54′ from the speed demand generated in block 50′ and the feedback speed signal $\omega_s$. The corrected base load demand and the frequency bias are summed in block 56′ to provide a total load demand, TLD.

The instantaneous power developed by the low pressure turbine as determined in block 80 is substracted from the total load demand, TLD, as indicated by block 82 to determine the load demand placed on the intermediate and the high pressure turbines. The instantaneous low pressure turbine power is determined in block 84 as a function of the actual steam conditions present in the low pressure turbines from the low pressure turbine steam flow and the drop in enthalpy of the steam as it courses through the low pressure turbines. A representation of low pressure turbine steam flow is generated in block 86 from low pressure turbine first-stage temperature and pressure and low pressure turbine exhaust pressure as represented by $T_4$, $P_4$ and $P_5$ respectively. Low pressure turbine steam enthalpy drop is determined in block 88. Since the steam supplied to the low pressure turbine in the typical multi-element turbine system illustrated in FIG. 3 is normally superheated, the low pressure turbine first-stage steam enthalpy can be determined from the low pressure turbine first-stage temperature and pressure $T_4$ and $P_4$. However, typically the low pressure turbine exhaust steam is saturated and since the state point of wet steam can not be determined as a function of steam temperature and pressure alone, the low pressure turbine exhaust steam enthalpy is determined in the illustrated system from the low pressure turbine steam flow and exhaust pressure as more fully discussed below.

The instantaneous power generated by the intermediate pressure turbine as determined in block 90 is subtracted in block 92 from the intermediate and high pressure turbine demand generated in block 82 to provide a high pressure turbine demand. A representation of the intermediate pressure turbine power is generated in block 91 as a function of the intermediate pressure turbine first-stage and exhaust steam conditions from the intermediate pressure turbine steam flow and enthalpy drop. The intermediate pressure turbine steam flow is determined in block 93 from the intermediate pressure turbine first-stage steam temperature and pressure and the exhaust pressure $T_3$, $P_3$ and $P_4$ respectively, in a manner similar to that in which the low pressure turbine steam flow is determined in block 86. However, since typically the intermediate pressure turbine exhaust steam remains superheated, the intermediate pressure turbine enthalpy drop may be determined in block 95 from the intermediate pressure turbine first-stage and exhaust temperatures and pressures alone.

The high pressure turbine demand is then employed in a manner similar to that in which the total load demand was utilized in the control loop arrangement 46 of FIG. 2 to generate the valve position set point signals, SP, as a function of the actual steam conditions existing in the high pressure turbine. Specifically, a turbine steam flow demand, QD, is generated in block 58′ from the high pressure turbine demand and the high pressure turbine enthalpy drop $\Delta h$. The latter is generated in block 60′ as a function of the high pressure turbine first-stage and exhaust steam conditions determined from the high pressure turbine first-stage and exhaust temperatures and pressures $T_1$, $T_2$ and $P_1$, $P_2$. The steam flow demand is processed in block 62′ together with the high pressure turbine first-stage temperature $T_1$ and exhaust pressure $P_2$ to generate high pressure turbine first-stage steam pressure demand or control signal $P_1D$ which is combined in block 64′ with the actual first-stage steam pressure $P_1$ to generate the inlet valve position set point signals, SP. The SP signals are then utilized by the valve positioners 40′ to position the inlet valves 26′.

Figure 5:
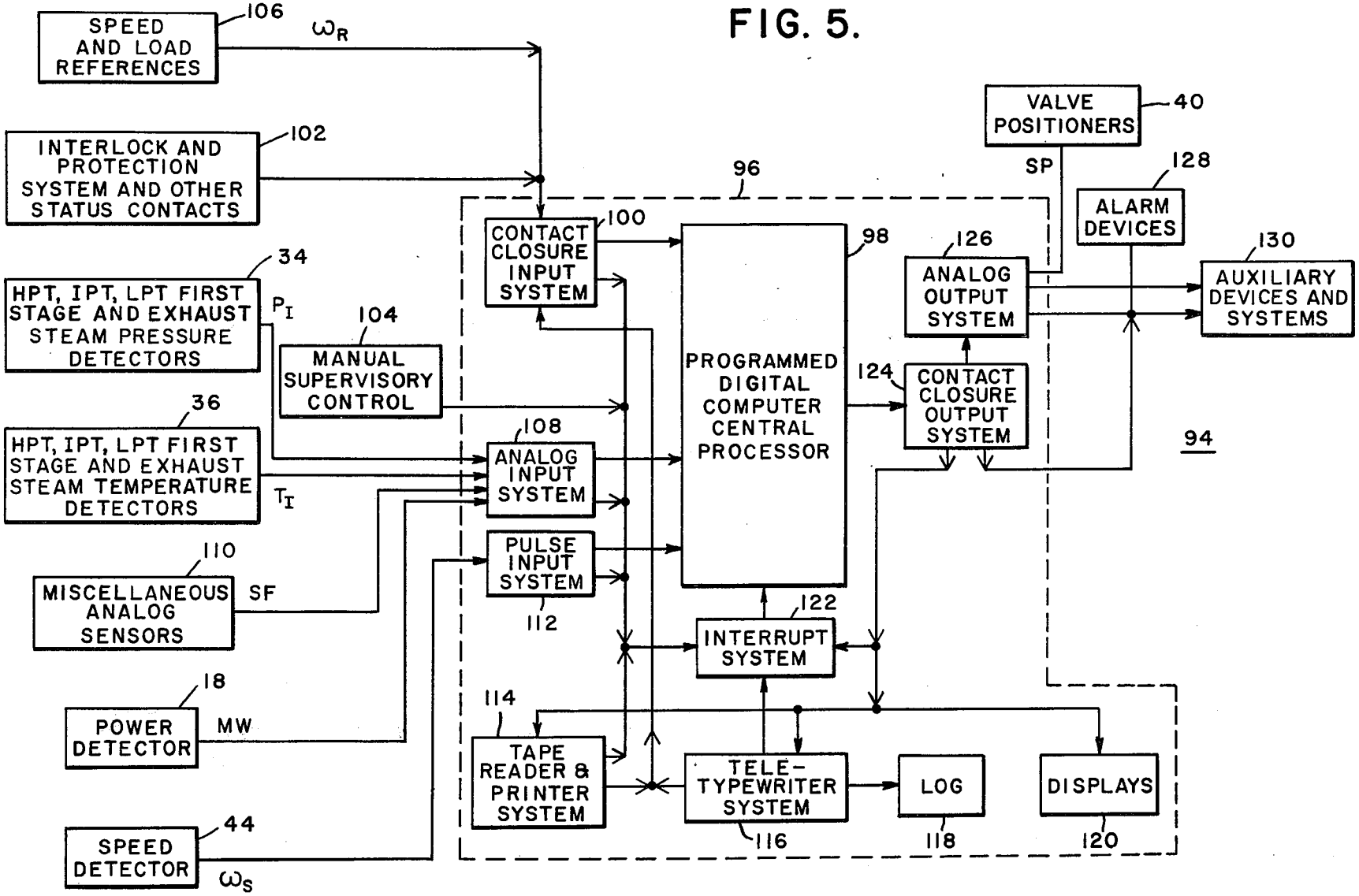
FIG. 5 is a schematic diagram of a programmed digital computer system operable with the steam turbines of FIGS. 1 and 3 in accordance with the principles of the invention.

The various sensors, the valve positioners 40 and the controller 42 shown in FIGS. 1 and 3, which implement the control loops of FIGS. 2 and 4, form a control system 94 which, in its preferred form illustrated in the block diagram of FIG. 5, includes a programmed digital computer system 96. This digital computer system can include conventional hardware in the form of a central processor 98 and associated input/output interfacing equipment, such as that sold by Westinghouse Electric Corporation and described in detail in "Westinghouse Engineer", May, 1970, Volume 30, No. 3, pages 88 through 93. As will be apparent from the description hereinbelow, the control system of this invention may utilize, for performing the indicated functions, any general purpose programmable computer having real time capability, in combination with the other control apparatus illustrated in FIGS. 1 and 3 and the required interface equipment, or equivalents thereof, as illustrated in FIG. 5. Also, it is to be understood that special purpose analog computer apparatus or wired logic may be utilized for performing the specific functions required to practice this invention in controlling the operation of any particular turbine.

The interfacing equipment for the central processor 98 includes a conventional contact closure input system 100 which scans contact or other similar signals representing the status of various plant and equipment conditions. Such contacts are indicated generally by the character 102 and might typically be contacts of mercury-wetted relays (not shown), which are operated by energization circuits (not shown) capable of sensing the predetermined conditions associated with various system devices. Status contact data is used in interlock logic functioning in control or other programs, protection and alarm system functioning, programmed monitoring and logging, demand logging, functioning of a computer executed manual supervisory control 104, etc.

The contact closure input system 100 also accepts digital speed and load reference signals as indicated by the reference character 106. The load reference can be manually set or it can be automatically supplied as by a dispatching system (not shown). In the load control mode of operation, the load demand defines the desired megawatt generating level and the computer control system 94 operates the turbine 10 to supply the power generating demand. The speed demand is used during startup, synchronization and in the load control mode of operation in generating the frequency bias which determines the frequency participation of the turbogenerator combination.

Input interfacing is also provided by a conventional analog input system 108 which samples analog signals from the plant 12 at a predetermined rate, such as 15 points per second for each analog channel input and converts the signal samples to digital values for computer entry. The analog signals are generated by the power detector 18, first-stage and exhaust steam pressure transducers 34 for each turbine section, first-stage and exhaust steam temperature detectors 36 for each turbine section, and miscellaneous analog sensors 110 such as various steam flow detectors, other steam temperature and pressure detectors, steam valve position detectors, miscellaneous equipment operating temperature detectors, generator hydrogen coolant pressure and temperature detectors, etc. (not shown). Many of these additional inputs are utilized by the computer control system 94 in performing, in addition to the real time control of turbine operation, the additional functions of system monitoring, sequencing, supervising, alarming, display and logging. A conventional pulse input system 112 provides for computer entry of the pulse type detector signals, such as those which may be generated by the speed detector 44.

Information input and output devices provide for computer entry and output of coded and noncoded information. These devices include a conventional tape reader and printer system 114 which is used for various purposes, including, for example, program entry into the central processor core memory. A conventional teletypewriter system 116 is also provided and is used for purposes including, for example, logging printouts as indicated by the reference character 118. Alphanumeric and/or other types of displays 120 are used to communicate current operation conditions or other information to the operator.

A conventional interrupt system 122 is provided with suitable known hardware and circuitry for controlling the input and output transfer of information between the computer processor 98 and the slower input/output equipment. Thus, an interrupt signal is applied to the processor 98 when an input is ready for entry or when an output transfer has been completed. In general, the central processor 98 acts on interrupts in accordance with a conventional executive program. In some cases, particular interrupts are acknowledged and operated upon without executive priority limitations.

Output interfacing is provided for the computer by means of a conventional contact closure output system 124 which operates in conjunction with a conventional analog output system 126. Certain computer digital outputs are applied directly in effecting program determined and contact controlled control actions of equipment, including alarm devices 128 such as buzzers and displays, and predetermined auxiliary devices and systems 130, such as the high pressure valve fluid and lubrication systems and the generator hydrogen coolant system (both not shown). Computer digital information outputs are similarly applied directly to the tape printer 114, the teletypewriter system 116 and the displays 120.

Other computer output signals are first converted to analog signals through functioning of the analog output system 126. The analog signals are then applied to the auxiliary devices and systems 130 and the valve positioners 40 in effecting program determined control actions. The respective signals applied to the steam valve positioners 40 are the valve position set point signals, SP, to which reference has previously been made.

Figure 6:
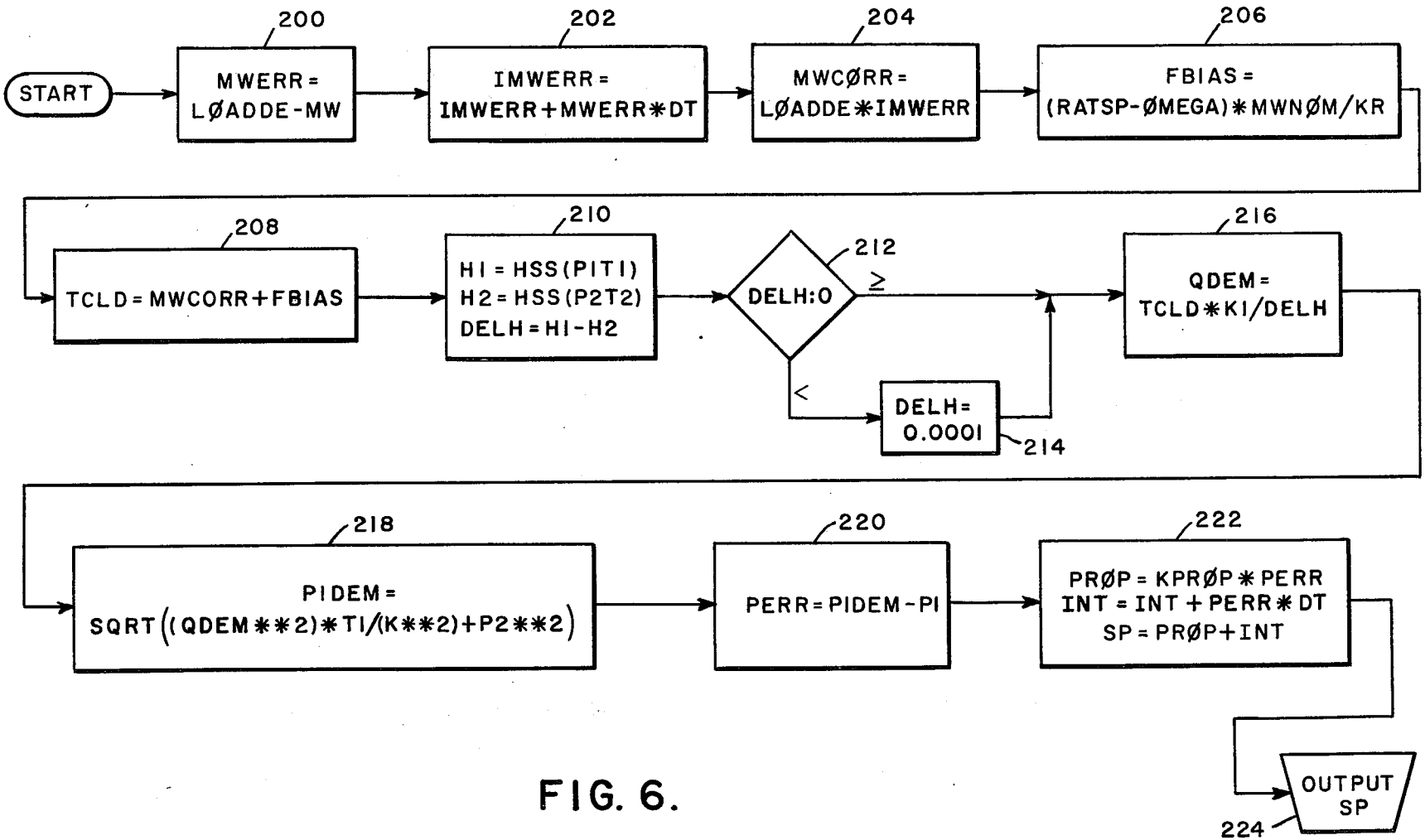
FIG. 6 shows a control logic flow diagram employed in part of an over-all programming system which operates the computer of FIG. 5 to control the single-element turbine of FIG. 1 in accordance with the principles of the invention.
Figure 7:
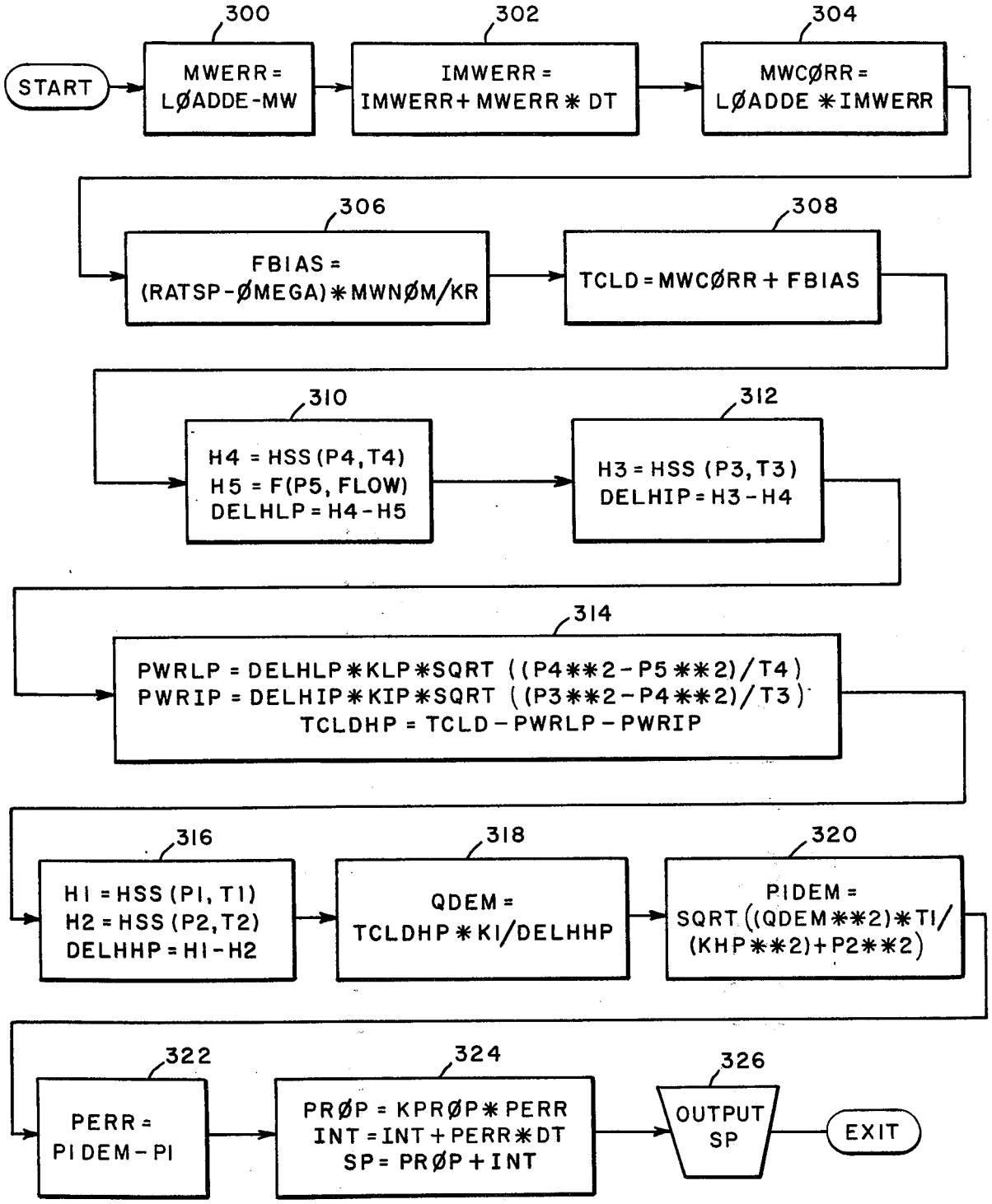
FIG. 7 shows a control logic flow diagram employed in part of an over-all programming system which operates the computer of FIG. 5 to control the multi-element turbine of FIG. 3 in accordance with the principles of the invention.

Referring now to FIGS. 6 and 7, there are shown flow diagrams representing the manner of generating the control signals used in the system of this invention as applied to the single element turbine system of FIG. 1 and the multi-element turbine system of FIG. 3 respectively. The operations indicated as carried out in these figures constitute, for the preferred embodiment where a programmed digital computer is utilized, portions of an overall programming system employed to operate the respective turbine systems. It is to be understood, however, that all or any specific portion of the functional operations illustrated in FIGS. 6 and 7 may be carried out either by special purpose digital or analog means or equivalent apparatus which provides the necessary real time capability. For operation with digital computer means, the Westinghouse W-2500 has the requisite capacity and is suitable for use as the central processor 98. In other cases, the Westinghouse Digital Electro-Hydraulic (DEH) Control System for large steam turbine generators may be utilized in practicing the invention. In fact, the control programs of the present invention may be substituted for the corresponding programs in the overall DEH programming system disclosed in the Giras application which has been incorporated by reference into this application, supra.

Table I, set forth below, provides definitions for the symbols used in the flow charts of FIGS. 6 and 7. It is to be noted that the arithmetic operations indicated by the flow charts are represented by equivalent Fortran symbols.

TABLE I

| | |
|---|---|
| DELH | change in enthalpy |
| DELHHP | change in enthalpy of high pressure turbine |

TABLE I-continued

| | |
|---|---|
| | steam |
| DELHIP | change in enthalpy of intermediate pressure turbine steam |
| DELHLP | change in enthalpy of low pressure turbine steam |
| DT | integration time increment |
| FBIA | frequency bias |
| H1-H5 | steam enthalpy at previously identified points in turbine system |
| HSS | steam table for determining enthalpy of saturated steam |
| IMWERR | integral of MWERR |
| INT | first-stage steam pressure error modified by integral control |
| K | proportionality factor |
| K1 | proportionality factor |
| KHP | proportionality factor |
| KIP | proportionality factor |
| KLP | proportionality factor |
| KPROP | proportional control gain factor |
| KR | frequency regulation factor |
| LOADDE | load demand |
| MW | generated electric power |
| MWCORR | corrected load demand |
| MWERR | megawatt error |
| MWNOM | megawatt nominal rating |
| OMEGA | actual speed ($\omega_s$) |
| P1-P5 | steam pressure at previously identified points in turbine system |
| P1DEM | first-stage steam pressure demand |
| PERR | first-stage steam pressure error |
| PROP | first-stage steam pressure error modified by proportional control |
| PWRIP | power developed by intermediate pressure turbine |
| PWRLP | power developed by low pressure turbine |
| QDEM | steam flow demand |
| RATSP | rated speed |
| SP | set point for first-stage steam pressure |
| T1-T5 | steam temperature at previously identified points in turbine system |
| TCLD | total corrected load demand |
| TCLDHP | total corrected load demand for high pressure turbine |

Referring first to FIG. 6, the flow chart associated with the single-element turbine of FIG. 1, block 200 represents the step of generating the megawatt error as the difference between the load demand placed on the turbine and the actual electrical power, MW, generated by the turbine system. In block 202 the integral of megawatt error, IMERR, is generated by a suitable routine, such as by adding to the cumulative integral of the megawatt error the product of the instantaneous megawatt error and DT, the time interval between calculations. The corrected load demand, MWCORR, is generated in block 204 by multiplying the load demand by the integral of the megawatt error to provide multiplication calibration feedforward load control.

The frequency bias is generated in block 206 by multiplying the speed error, calculated as the difference between the rated speed, RATSP, and the actual speed, OMEGA, by the nominal megawatt rating, MWNOM, divided by the frequency bias factor, KR. For purposes of illustration, the nominal megawatt rating is defined as the guaranteed maximum generated load. The ratio then of the nominal megawatt rating to the frequency bias factor determines the gain of the speed feedback loop and, therefore, the frequency participation of the illustrated turbine system in an electric power network. The total corrected load demand is then calculated in block 208 as the sum of the corrected load and the frequency bias.

The function of determining the enthalpy drop as the steam courses through the turbine is represented by block 210 and includes the calculation of the first-stage steam enthalpy $H_1$, and the exhaust enthalpy $H_2$. In order to determine the thermodynamic state of the steam at various parts of the turbine system, including the first-stage and exhaust enthalpy, the computer system is provided with a library of steam table routines. Steam tables which list the properties of steam in tabular form are well-known in the field of thermodynamics. The tables set forth in Keenan and Keyes, "Thermodynamic Properties of Steam" have been used for many years and more recently the steam tables prepared by the American Society of Mechanical Engineers have gained wide acceptance. A detailed description of the development of steam table programs for digital computers is set forth in "Formulations of Iterative Procedure for the Calculation of the Properties of Steam", by R. D. McClintock and G. J. Silvestri, published by the American Society of Mechanical Engineers in 1968, Library of Congress card number 68-22685. Packaged steam table routines for digital computers are available for purchase and have been used by turbine designers for some time. As disclosed in the commonly assigned copending application of Chu Yu Liang referred to supra, the steam table routines may be applied by the computer to provide continuous monitoring of the turbine system contemporaneously with turbine control.

Turbine first-stage and exhaust enthalpy $H_1$ and $H_2$ are calculated by using the steamtable routine for calculating the enthalpy of superheated steam from steam temperature and pressure made available to the computer through sensors 36 and 34 respectively. The drop in enthalpy is then determined as the difference between the first-stage and exhaust enthalpy. It is possible that the calculated enthalpy drop could become negative under certain circumstances, such as the sudden dropping of electrical load. In this case, the enthalpy drop, DELH, is compared with zero in block 212 and is set to a nominal positive figure such as 0.0001 in block 214, if the calculated drop is in fact negative.

Next, the flow demand, QDEM, is generated in block 216 by dividing the total corrected load demand, TCLD, by the enthalpy drop and multiplying the quotient by the gain K1. This step represents an inversion of the well-known relationship employed by turbine designers, that the power developed by a steam turbine is equal to the steam flow multiplied by the drop in steam enthalpy. In the present circumstance, the desired load to be carried by the turbine is converted into a representation of the steam flow required to meet the desired load demand.

The flow demand, QDEM, is then utilized in block 218 together with the turbine first-stage steam temperature $T_1$ and exhaust pressure $p_2$ to determine the required first-stage steam pressure $P_1$DEM necessary to produce the steam flow demanded. This calculation is derived from a rearrangement of the following relationship also employed by turbine designers in which the flow of steam through a turbine may be determined as a function of turbine first-stage and exhaust pressure together with first-stage temperature:

$$Q = \frac{P_1^2 - P_2^2}{T_1} * K \qquad \text{Equation 1}$$

The calculated first-stage steam pressure demand signal $P_1$DEM is then compared with the actual pressure $P_1$ in block 220 to generate a first-stage steam pressure error, PERR. Proportional and integral control are then applied to the error signal in block 222 to generate the first-stage steam valve set point signal, SP, which is outputed to the valve positioners in block 224.

Referring now to FIG. 7 which illustrates, as mentioned, a flow chart suitable for controlling the multi-element turbine system of FIG. 3 in accordance with the principles of the invention, the generation of the megawatt error, MWERR, in block 300, the integral of the megawatt error, IMWERR, in block 302, the corrected load demand, MWCORR, in block 304, the frequency bias in block 306 and the total corrected load demand in block 308 to provide multiplication calibration feedforward control of load demand and feedback frequency regulation and participation is identical to that discussed in regard to the single element turbine system flow chart illustrated in FIG. 6.

Figure 8:
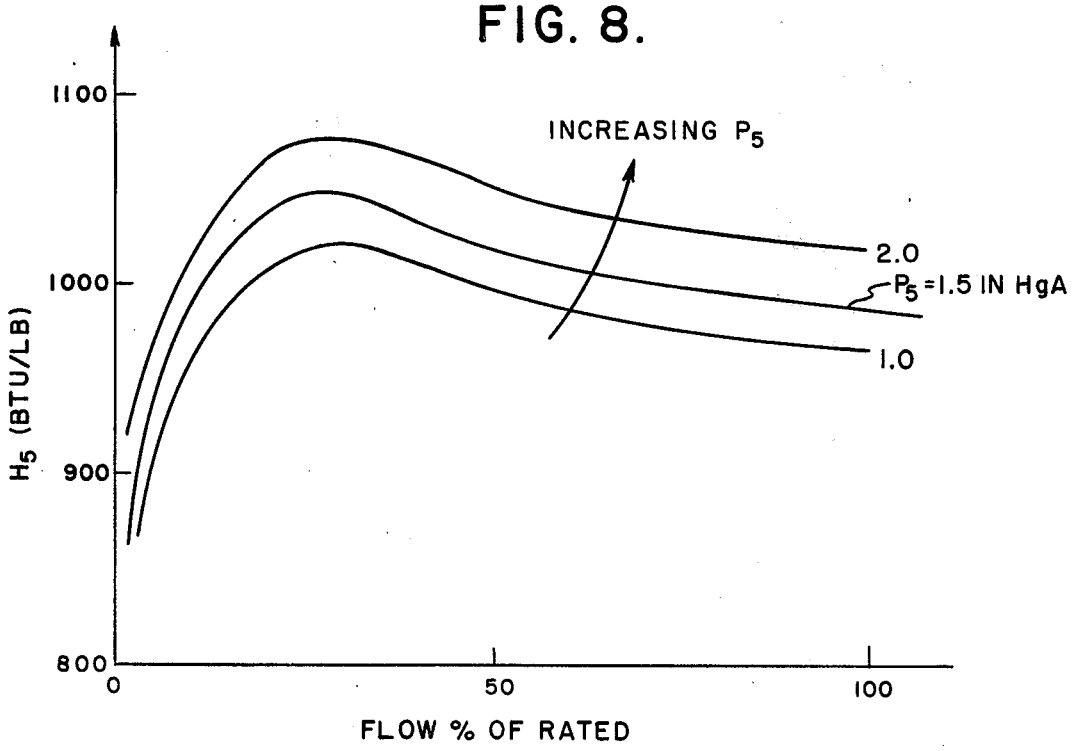
FIG. 8 is a graphical representation of the relationship between the enthalpy and flow of exhaust steam from a typical low-pressure turbine which is useful in certain applications of the invention.

The low pressure turbine first-stage and exhaust steam enthalpies, $H_4$ and $H_5$, which are representative of the actual steam conditions present in the low pressure turbine, are calculated and subtracted to determine the low pressure turbine steam enthalpy drop, DELHLP, in block 310. Since, as discussed above, the steam supplied to the low pressure turbine in the typical multi-element turbine system illustrated in FIG. 3 is normally superheated, the low pressure turbine first-stage steam enthalpy $H_4$ is determined by the computer through the HSS steam table routine as a function of the low pressure turbine first-stage steam temperature and pressure in the same manner as that discussed with regard to determining the first-stage and exhaust steam enthalpies in block 210 of FIG. 6. However, since as also discussed above the low pressure turbine exhaust steam is typically saturated, other means must be provided for determining $H_5$ under these circumstances. FIG. 8 illustrates a characterization of the low pressure turbine exhaust steam enthalpy as a function of the exhaust steam pressure $P_5$ and flow. The relationship may be stored in the digital computer as a family of curves. Curve fitting routines which provide the digital computer with the capability of calculating the unknown one of two variables which are a continuous function of each other and for interpolating between a family of such curves are well-known. The family curves to which this routine is applied may be developed theoretically or empirically. As an alternative, the techniques developed in the Liang application, which has been incorporated by reference above into this application may be utilized to determine the enthalpy of the wet steam. It is to be understood that in some turbine systems, such as the light water reactor (LWR) nuclear-fueled turbine systems, other portions of the system may be operating on wet steam and, therefore, techniques such as those discussed above must be employed to determine the state of the steam under those conditions. As disclosed in the Liang application, the PWR nuclear-fueled turbine system does not include an intermediate pressure turbine, but the wet steam exhausted by the high pressure turbine is passed through mechanical moisture separators and a reheater to raise the steam enthalpy so that the steam supplied to the multiple low pressure turbines is superheated.

Returning to FIG. 7, the change in steam conditions in the intermediate pressure turbine, as represented by the enthalpy drop, DELHIP, is determined in block 312 as the difference between the first-stage steam enthalpy $H_4$ calculated in block 310 and the exhaust steam enthalpy calculated from the steam tables as a function of $P_3$ and $T_3$. The total load demand placed on the high pressure turbine, TCLDHP, is then calculated in block 314 by subtracting the power developed by the low pressure turbine, PWRLP, and the intermediate pressure turbine, PWRIP, from the total corrected load demand placed on the system, TCLD. The power developed by the low pressure turbine is calculated by multiplying the low pressure turbine steam enthalpy drop by the low pressure turbine steam flow. The latter is determined from the relationship expressed in Equation 1 above, in which the following substitutions are made: $P_1 = P_4$, $P_2 = P_5$ and $T_1 = T_4$. Similarly, the intermediate pressure turbine power is calculated in the same manner with an appropriate substitution of variables.

The set point signal for the turbine inlet valves is then generated in a manner similar to that employed in the flow chart of FIG. 6 by determining the drop in steam enthalpy in the high pressure turbine as a function of the high pressure turbine first-stage and exhaust steam enthalpies in block 316, calculating steam flow demand in block 318 from the total corrected load demand placed on the high pressure turbine and the enthalpy drop therein, producing a first-stage steam pressure demand in block 320 through appropriate rearrangement and substitution in Equation 1, generating a first-stage steam pressure error in block 322 to which proportional and integral control action is applied in block 324 and outputing the thus generated set point signal in block 326.

It will be understood by those skilled in the art that the functional blocks illustrated in FIGS. 6 and 7 are illustrative and that the functions called for can be combined, separated and in many instances rearranged, all within the spirit and scope of the present invention.

It will also be appreciated by those skilled in the art that control of a steam turbine system as a function of the actual steam conditions present in the turbine in accordance with the principles of this invention provides faster and more precise turbine control. As applied to a multi-element turbine system, it can be further appreciated that this improved performance is achieved by operating the high pressure turbine section to generate the difference between the total load demand placed on the turbine system and the power developed by the lower pressure tubines such that changes in load demand brought about through changes in load demand assigned to the turbine or load induced frequency changes are quickly and precisely accommodated for initially by the faster acting high pressure turbine section until the slower reacting lower pressure turbine sections respond to the change in demand. By continuously monitoring the power developed by the intermediate and the low pressure turbine sections, the power developed by the high pressure turbine is continuously and accurately readjusted to maintain the desired total turbine output as the lower pressure turbine sections respond to the change in demand. The control features disclosed could also be combined with an on-line plant and component performance monitoring system to provide a total integrated system.

The foregoing description has been presented to illustrate the principles of the invention, and it is to be understood that the means for carrying out the various functions performed in the practice of this invention are illustrative to the preferred embodiment. Accordingly, it is desired that the inveniton not be limited by the embodiment described, but rather that it be afforded a scope consistent with its broad principles.

What is claimed is:

1. An improved steam turbine system comprising:
a steam turbine in which steam expands as it imparts torque to the turbine shaft;
means for generating a representation of the drop in steam enthalpy resulting from the expansion of steam in the turbine; and
means for controlling the operation of said turbine as a function of said steam enthalpy drop representation, whereby the turbine is controlled as a function of the actual steam conditions in the turbine.

2. The turbine system of claim 1 wherein the means for generating said steam enthalpy drop representation includes means for determining the turbine first-stage and exhaust steam state points and means for calculating the enthalpy drop as a function of said state points.

3. The system of claim 2 wherein said control means includes means for generating a turbine steam flow demand signal as a function of said enthalpy drop representation, and flow control means for controlling the flow of steam to the turbine as a function of said flow demand signal.

4. The system of claim 1 including means for generating signals representative of the turbine first-stage and exhaust steam temperatures and pressures and wherein the means for generating the steam enthalpy drop representation includes means for calculating said enthalpy drop as a function of said temperatures and pressures.

5. The system in claim 4 wherein said control means includes control signal generating means for generating a turbine first-stage steam pressure demand signal as a function of said enthalpy drop representation, the turbine first-stage steam temperature and the turbine exhaust steam pressure and wherein the control means further includes a valve for controlling the flow of steam to the turbine and means for positioning the valve as a function of said turbine first-stage steam pressure demand signal.

6. The system of claim 5 wherein the control signal generating means includes means for generating a turbine steam flow demand signal as a function of said enthalpy drop representation and means for generating the turbine first-stage steam pressure demand signal in accordance with the following relationship $$P_1D = \sqrt{\frac{Q^2T_1}{K^2} + P_2^2}$$

wherein $P_1D$ is the turbine first-stage pressure demand, $Q$ is the turbine steam flow demand signal, $T_1$ is the turbine first-stage steam temperature, $P_2$ is the turbine exhaust pressure and $K$ is a constant, and wherein said control means includes a servo loop comprising means for maintaining the actual turbine first-stage steam pressure at the valve determined by the turbine first-stage steam pressure demand signal.

7. A system for operating a steam turbine comprising:
means for generating a turbine steam flow demand signal;
means for generating a representation of turbine first-stage steam temperature and turbine exhaust steam pressure;
means for generating a turbine first-stage steam pressure demand signal as a function of said steam flow demand signal, first-stage steam temperature, and exhaust steam pressure representations; and
means for controlling the flow of steam to the turbine as a function of said turbine first-stage steam pressure demand signal.

8. The system of claim 7 wherein said control means includes means for determining the actual turbine first-stage steam pressure and a servo control for maintaining the turbine first-stage steam pressure at the value determined by the control signal.

9. The system of claim 7 wherein the means for generating the turbine first-stage steam pressure demand signal generates the same in accordance with the relationship $$P_1D = \sqrt{\frac{Q^2T_1}{K^2} + P_2^2}$$

wherein $P_1D$ is the turbine first-stage steam pressure demand, $Q$ is the turbine steam flow demand signal, $T_1$ is the turbine first-stage steam temperature, $P_2$ is the turbine exhaust steam pressure and $K$ is a constant.

10. A control system for a steam turbine comprising:
means for determining turbine first-stage and exhaust actual steam conditions;
means for generating a turbine operating representation as a function of said turbine first-stage and exhaust actual steam conditions; and
means for controlling steam flow to the turbine as a function of said operating representation.

11. The control system of claim 10 including means for determining turbine speed and for generating a turbine speed signal and wherein the means for generating a turbine operating repreentation generates said representation as a function of said turbine speed signal when said control system is controlling the speed of said turbine.

12. The control system of claim 10 including means for generating a signal representative of the load to be carried by the turbine and wherein the means for generating a turbine operating representation generates said representation as a function of said load signal when said control system is controlling turbine load.

13. A system for operating a steam turbine supplied with steam at variable state points comprising:
means for generating a representation of the actual change in steam conditions as the steam expands in the turbine; and
means for controlling steam flow to the turbine as a function of said actual change in steam condition representation whereby the turbine is accurately controlled despite changes in supply steam conditions.

14. The system of claim 13 wherein said control means controls said steam flow as to change turbine speed.

15. The system of claim 13 wherein said control means controls said steam flow as to change the load carried by the turbine.

16. A digital computer control system for controlling steam turbine operation, comprising:
means for determing turbine first-stage and exhaust steam temperatures and pressures;

means for generating a predetermined turbine reference representation;

general purpose programmed digital computer means for performing the function of generating a turbine operating representation as a function of said first-stage and exhaust temperatures and pressures and said reference representation; and steam valve means for controlling the flow of steam to the turbine as a function of said turbine operating representation.

17. The digital computer control system of claim 16 wherein said general purpose programmed digital computer means performs the following functions:

generating a representation of the first-stage steam enthalpy as a function of the first-stage steam temperature and pressure representations;

generating a representation of the exhaust steam enthalpy as a function of the exhaust steam temperature and pressure representatons;

generating a representation of the drop in steam enthalpy as a function of the difference between the first-stage and exhaust steam enthalpy representations;

generating a representation of turbine steam flow demand as a function of said turbine reference representation and said enthalpy drop representation; and generating said operating representation as a function of said steam flow demand representation, said turbine first-stage steam temperature representation and said turbine exhaust pressure representation.

18. The digital computer control system of claim 17 including means for determining turbine speed and for generating a turbine speed signal and means for generating a predetermined turbine load demand signal, and wherein the reference representation generating means comprises means for generating said representation as a function of said turbine speed signal and said load demand signal.

19. The digital computer control system of claim 18 including means for determining the actual load carried by the turbine and for generating a turbine load signal and wherein said reference representation generating means includes means for modifying said predetermined load demand signal as a function of said turbine load signal.

20. An improved steam turbine system comprising:

a high pressure turbine;

a low pressure turbine;

means for directing the flow of steam from the high pressure turbine to the low pressure turbine;

means for generating a representation of a predetermined total turbine power demand;

means for generating a representation of the power developed by the low pressure turbine;

means for generating a high pressure turbine power demand representation as the difference between the predetermined total turbine power demand representation and the low pressure turbine power representation; and means for operating the high pressure turbine to develop the power called for by said high pressure turbine power demand representation.

21. The system of claim 20 wherein the operating means includes control valve means for controlling the flow of steam to the high pressure turbine section.

22. The system of claim 21 wherein the means for directing the flow of steam from the high pressure turbine section to the low pressure turbine section includes a reheat means for raising the enthalpy of the steam.

23. The system of claim 22 including an intermediate pressure turbine and means for generating a representation of the power developed by said intermediate pressure turbine and wherein the means for directing the flow of steam from the high pressure turbine to the low pressure turbine includes means for directing the steam from the high pressure turbine through the reheat means and the intermediate pressure turbine to the low pressure turbine and wherein the means for generating a representation of the high pressure turbine demand generates said representation as the difference between the total power demand representation and both the low pressure turbine and the intermediate pressure turbine power representations.

24. The system of claim 20 wherein the means for generating a representation of the power developed by the low pressure turbine includes means for generating a representation of the drop in enthalpy of the steam as it expands in the low pressure turbine, means for generating a representation of the flow of steam through the low pressure turbine and means for generating the low pressure turbine power representation as a function of the enthalpy drop representation and the steam flow representation.

25. The system of claim 20 including means for determining the low pressure turbine first-stage and exhaust steam temperatures and pressures and wherein said means for generating a representation of the power developed by the low pressure turbine generates said representation as a function of said temperatures and pressures.

26. An improved turbine system comprising:

a steam turbine having a high pressure turbine element and a low pressure turbine element;

means for generating representations of the steam conditions in each turbine element; and means for controlling the operation of the turbine as a function of the representations of the steam conditions in each turbine element.

27. The turbine system of claim 26 wherein the means for generating a representation of the steam conditions in each turbine element includes means for determining the enthalpy drop across each turbine element and means for generating a control signal as a function of said enthalpy drops and wherein said control means includes means for controlling the flow of steam to the high pressure turbine element as a function of said control signal.

28. The turbine system of claim 27 wherein the means for determining the enthalpy drops across each turbine element include means for determining the first-stage and exhaust temperature and pressure for each turbine element and means for calculating the enthalpy drops from said temperatures and pressures.

29. The system of claim 28 wherein the means for generating said control signal includes means for generating a low pressure turbine element power signal as a function of the low pressure turbine element enthalpy drop, and means for generating a valve position signal as a function of said low pressure turbine element power signal and high pressure turbine element enthalpy drop and wherein said control means includes valve means for controlling the flow of steam to the high pressure turbine element and means for positioning said valve as a function and said valve position signal.

30. A digital computer control system for controlling the operation of a steam turbine having a high pressure turbine element, a low pressure turbine element and a reheater for reheating the steam passing from the high pressure turbine element to the low pressure turbine element, said system comprising:

means for determining the first-stage and exhaust steam temperature and pressure of each turbine element and for generating representations thereof;

means for generating a representation of a predetermined total turbine load demand;

general purpose programmed digital computer means for performing the functions of generating a representation of the power developed by the low pressure turbine element as a function of the low pressure turbine first-stage and exhaust steam temperature and pressure representations, and generating an operating representation as a function of said low pressure turbine element power representation, the total load demand representation, and the high pressure turbine element first-stage and exhaust steam temperature and pressure representations; and steam valve means for controlling the flow of steam to said turbine as a function of said operating representation.

31. The digital computer control system of claim 30 wherein said general purposed programmed digital computer means performs the following functions;

generates a representation of the low pressure turbine element steam enthalpy drop;

generates a representation of the low pressure turbine element steam flow as a function of the low pressure turbine first-stage and exhaust steam pressure representations and the low pressure turbine first-stage steam temperature representation;

generates the low pressure turbine element power representation as a function of said low pressure turbine element steam enthalpy drop and steam flow representations;

generates a high pressure turbine element load demand representation as the difference between the total load demand representation and the low pressure turbine element power representation;

generates a high pressure turbine element steam enthalpy drop representation as a function of the high pressure turbine first-stage and exhaust steam temperatures and pressures;

generates a high pressure turbine element steam flow control representation as a function of said high pressure turbine element load demand representation and said high pressure turbine element enthalpy drop representation; and generates said operating representation as a function of said high pressure turbine element steam flow control representation, and said high pressure turbine section steam first-stage temperature and exhaust pressure representations.

32. An improved method for operating a steam turbine in which the steam expands as it imparts torque to the turbine shaft, said method comprising the steps of:

generating a signal representing the drop in steam enthalpy resulting from the expansion of the steam in the turbine;

generating a control signal as a function of said signal representing the steam enthalpy drop; and controlling the operation of the turbine as a function of said control signal, whereby the power generated by the turbine is controlled in accordance with the actual steam conditions in the turbine.

33. The method of operating a steam turbine described in claim 32 wherein the step of generating said steam enthalpy drop signal includes the steps of generating signals representative of the turbine first-stage steam and exhaust steam state points and generating the enthalpy drop signal as a function of said first-stage and exhaust steam state point signals.

34. The method of operating a steam turbine described in claim 32, including the step of generating turbine first-stage and exhaust steam pressure and temperature signals, and wherein the enthalpy drop signal is generated as a function of said first-stage exhaust steam temperature and pressure signals.

35. The method of operating a steam turbine described in claim 33 wherein the step of generating the control signal includes the step of generating a turbine steam flow control signal as a function of said enthalpy drop representation and wherein the step of controlling the operation of the turbine comprises the step of controlling the flow of steam to the turbine as a function of the control signal.

36. The method of operating a steam turbine described in claim 35, including the step of generating a load demand signal of predetermined value and wherein said turbine steam flow control signal is generated as a function of said load demand signal and said enthalpy drop representation.

37. The method of operating a steam turbine as described in claim 36 wherein the turbine steam flow control signal is generated as the quotient of the load demand divided by the enthalpy drop.

38. The method of operating a steam turbine described in claim 37 including the step of generating turbine first-stage steam temperature and exhaust steam pressure signals and wherein the step of generating the control signal includes the step of generating a turbine first-stage steam pressure demand signal as a function of said turbine steam flow control signal and said turbine first-stage steam temperature and exhaust steam pressure signals and wherein the step of controlling the operation of the turbine comprises the step of regulating the flow of steam to the turbine to maintain the turbine first-stage steam pressure at the value determined by the turbine first-stage steam pressure demand signal.

39. An improved method of operating a steam turbine comprising the steps of:

generating a signal representative of turbine steam flow demand;

generating signals representative of turbine first-stage steam temperature and exhaust steam pressure;

generating a turbine first-stage steam pressure demand signal as a function of said turbine steam flow demand, first-stage steam temperature and exhaust steam pressure signals; and controlling the flow of steam to the turbine as a function of said turbine first-stage steam pressure demand signal.

40. The improved method of operating a steam turbine as described in claim 39 wherein the turbine first-stage steam pressure demand signal is generated according to the equation:

$$P_1D = \sqrt{\frac{Q^2T_1}{K^2} + P_2^2}$$

where $Q$ is turbine steam flow demand signal, $t_1$ is turbine inlet steam temperature, $P_2$ is turbine exhaust steam pressure and $K$ is a proportionality constant.

41. A method of controlling a steam turbine comprising the steps of:

generating a representation of actual steam conditions at the turbine first-stage and exhaust;

generating a control signal as a function of said first-stage and exhaust steam condition representations; and controlling the flow of steam to the turbine as a function of said control signal.

42. The method of controlling a steam turbine as described in claim 41 including the step of varying the steam conditions of the steam supplied to the turbine over at least a portion of the operating range of the turbine.

43. The method of controlling a steam turbine described in claim 41 comprising controlling the flow of steam to the turbine as to change turbine speed.

44. The method of controlling a steam turbine described in claim 41 comprising controlling the flow of steam to the turbine as to change the load carried by the turbine.

45. A digital computer control method for controlling steam turbine operations, comprising:

determining turbine first-stage and exhaust steam temperature and pressure;

generating a turbine reference representation;

generating, with a general purpose programmed digital computer, a turbine operating representation as a function of turbine steam first-stage and exhaust temperature and pressures and said turbine reference representation; and controlling steam flow to the turbine as a function of said operating representation.

46. The digital computer control method as described in claim 44 comprising performing the following steps with said general purpose programmed digital computer:

generate a representation of the first-stage steam enthalpy as a function of the inlet steam temperature and pressure representations;

generate a representation of the exhaust steam enthalpy as a function of the exhaust steam temperature and pressure representations;

generate a representation of the drop in steam enthalpy as a function of the difference between the first-stage and exhaust steam enthalpy representations;

generate a representation of turbine steam flow demand as a function of said turbine reference representation and said enthalpy drop representation; and generate said operating representation as a function of said steam flow demand representation, said turbine first-stage steam temperature representation and said turbine exhaust pressure representation.

47. The digital computer control method as described in claim 46 including the steps of determining turbine speed and generating a predetermined load demand representation and wherein said turbine reference representation is generated as a function of turbine speed and said load demand representation.

48. The digital computer control method of claim 45 including the steps of determining the actual load carrier by the turbine and modifying the load demand representation as a function of said actual load.

49. A method of operating a steam turbine comprising a plurality of turbine elements, including the steps of:

supplying a flow of steam to the first turbine element;

directing the flow of steam from the exhaust of the first turbine element to the other turbine elements;

generating a total power demand representation, representative of the total power to be generated by the turbine;

generating representations of the instantaneous power developed by said other turbine elements;

generating a first turbine element power demand representation as the difference between the total power demand representation and the other turbine element instantaneous power representations; and controlling the flow of steam to the first turbine element as a function of the first turbine element power demand representation.

50. The method of claim 49 including the step of reheating the steam flowing from the first turbine element to raise the enthalpy thereof before directing said steam flow to the other turbine elements.

51. The method of claim 49 including the step of varying the steam conditions of the steam supplied to said first turbine element.

52. The method of claim 49 including the step of varying the pressure of the steam supplied to the first turbine element substantially linearly as a function of the total power demand placed on the turbine at least over a predetermined portion of the turbine generating range.

53. An improved method of operating a steam turbine having a high pressure turbine element and a low pressure turbine element comprising the steps of:

generating representations of the steam conditions in each turbine element;

generating a control signal as a function of said steam condition representations; and controlling the operation of the turbine as a function of said control signal.

54. The improved method of operating a steam turbine as described in claim 53 including the steps of generating representations of the drop in steam enthalpy in each turbine element as a function of said steam condition representations and generating said control signal as a function of said enthalpy drops.

55. The improved method of operating a steam turbine as described in claim 54 including the steps of determining turbine first-stage and exhaust steam temperature and pressure for each turbine element and generating said representations of the drop in steam enthalpy in each turbine element as a function of the respective first-stage and exhaust steam temperature and pressure.

56. The improved method of operating a steam turbine as directed in claim 54 including the steps of generating a representation of steam flow through said low pressure turbine element, generating a representation of the power developed by the low pressure turbine element as a function of said low pressure turbine element steam flow and the low pressure turbine element enthalpy drop representation, generating a representation of a predetermined total load to be carried by the turbine, generating a high pressure turbine element load demand representation as the difference between said total load demand and the low pressure turbine element power representation, generating a high pressure turbine element flow control signal as a function of said high pressure turbine element load demand and said high pressure turbine element enthalpy drop representation, and controlling the flow of steam to the turbine as a function of said flow control signal.

57. The improved method of operating a steam turbine as described in claim 56, including the steps of determining the high pressure turbine element first-stage steam temperature and exhaust steam pressure, generating a high pressure turbine element first-stage steam pressure control signal as a function of said high pressure turbine element steam flow control signal and said high pressure turbine element first-stage steam temperature and exhaust steam pressure, and controlling the flow of steam to the high pressure turbine element as a function of said high pressure turbine element first-stage steam pressure control signal.

58. A digital computer control method for controlling the operation of a steam turbine having a high pressure turbine element and a low pressure turbine element, comprising the steps of:

generating representations of the first-stage and exhaust steam temperature and pressure for each turbine element;

generating a representation of a predetermined total turbine load demand;

generating, with a general purpose programmed digital computer, a representation of the power developed by the low pressure turbine element as a function of the low pressure turbine element first-stage and exhaust steam temperature and pressure representations, and an operating representation as a function of said low pressure turbine element power representation, the total load demand representation and the high pressure turbine element first-stage and exhaust steam temperature and pressure representations; and controlling the flow of steam to the turbine as a function of said operating representation.

59. The digital computer control method as described in claim 58 comprising performing the following steps with said general purpose programmed digital computer:

generate a representation of the low pressure turbine element steam enthalpy drop as a function of said low pressure turbine element first-stage and exhaust steam temperature and pressure representations;

generate a representation of the low pressure turbine element steam flow as a function of the low pressure turbine element first-stage and exhaust steam pressure representations and the low pressure turbine element first-stage steam temperature representation;

generate the low pressure turbine element power representation as a function of said low pressure turbine element steam enthalpy drop and steam flow representations;

generate a high pressure turbine element load demand representation as the difference between the total load demand representation andthe low pressure turbine element power representation;

generate a high pressure turbine element steam enthalpy drop representation as a function of the high pressure turbine element first-stage and exhaust steam temperatures and pressures;

generate a high pressure turbine element steam flow control representation as a function of said high pressure turbine element load demand representation and said high pressure turbine element enthalpy drop representation; and generate said operating representation as a function of said high pressure turbine element steam flow control representation, and said high pressure turbine element first-stage steam temperature and exhaust steam pressure representations.

* * * * *